US005158866A

United States Patent [19]

Simpson et al.

[11] Patent Number: 5,158,866

[45] Date of Patent: Oct. 27, 1992

[54] POST-PROCESSING STABILIZATION OF PHOTOTHERMOGRAPHIC EMULSIONS WITH AMIDO COMPOUNDS

[75] Inventors: Sharon M. Simpson, Lake Elmo; Larry R. Krepski, White Bear Lake; Kumars Sakizadeh; David R. Whitcomb, both of Woodbury, all of Minn.

[73] Assignee: Minnesota Mining and Manufacturing Company, St. Paul, Minn.

[21] Appl. No.: 575,838

[22] Filed: Aug. 31, 1990

[51] Int. Cl.[5] ..... G03C 1/34; G03C 1/498

[52] U.S. Cl. ..... 430/617; 430/607; 430/611; 430/613; 430/964

[58] Field of Search ..... 430/617, 607, 611, 613, 430/964

[56] References Cited

U.S. PATENT DOCUMENTS

| | | | |
|---|---|---|---|
| 4,137,079 | 1/1979 | Houle | 96/55 |
| 4,138,265 | 2/1979 | Shiao | 96/114.1 |
| 4,245,033 | 1/1981 | Eida et al. | 430/353 |
| 4,378,424 | 3/1983 | Altland et al. | 430/352 |
| 4,451,561 | 5/1984 | Hirabayashi et al. | 430/619 |
| 4,511,644 | 4/1985 | Okamura et al. | 430/960 |
| 4,837,141 | 6/1989 | Kohno et al. | 430/559 |

OTHER PUBLICATIONS

Encyclopedia of Polymer Sciences and Engineering, vol. 11, 2nd. Ed. (1988) Rasmussen et al., "Polyazyltones", pp. 558–571.

Research Disclosure 16977, "Antifoggants in certain photographic and photothermographic materials".

*Primary Examiner*—Charles L. Bowers, Jr.

*Assistant Examiner*—Thorp Chea

*Attorney, Agent, or Firm*—Gary L. Griswold; Walter N. Kirn; Mark A. Litman

[57] ABSTRACT

The post-processing stability of silver halide photothermographic emulsions is enhanced by the presence of stabilizing amounts of certain structurally defined amido compounds.

22 Claims, No Drawings

POST-PROCESSING STABILIZATION OF PHOTOTHERMOGRAPHIC EMULSIONS WITH AMIDO COMPOUNDS

FIELD OF THE INVENTION

This invention relates to photothermographic materials and in particular to post-processing stabilization of dry silver systems.

BACKGROUND OF THE ART

Silver halide photothermographic imaging materials, especially "dry silver" compositions, processed with heat and without liquid development have been known in the art for many years. Such materials are a mixture of light insensitive silver salt of an organic acid (e.g., silver behenate), a minor amount of catalytic light sensitive silver halide, and a reducing agent for the silver source.

The light sensitive silver halide is in catalytic proximity to the light insensitive silver salt such that the latent image formed by the irradiation of the silver halide serves as a catalyst nucleus for the oxidation-reduction reaction of the organic silver salt with the reducing agent when heated above 80° C. Such media are described in U.S. Pat. Nos. 3,457,075; 3,839,049; and 4,260.677. Toning agents can be incorporated to improve the color of the silver image of photothermographic emulsions as described in U.S. Pat. Nos. 3,846,136; 3,994,732 and 4,021,249. Various methods to produce dye images and multicolor images with photographic color couplers and leuco dyes are well known in the art as represented by U.S. Pat. Nos. 4,022,617; 3,531,286; 3,180,731; 3,761,270; 4,460,681; 4,883,747 and Research Disclosure 29963.

A common problem that exists with these photothermographic systems is the instability of the image following processing. The photoactive silver halide still present in the developed image may continue to catalyze print-out of metallic silver even during room light handling. Thus, there exists a need for stabilization of the unreacted silver halide with the addition of separate post-processing image stabilizers or stabilizer precursors to provide the desired post-processing stability. Most often these are sulfur containing compounds such as mercaptans, thiones, thioethers as described in Research disclosure 17029. U.S. Pat. No. 4,245,033 describes sulfur compounds of the mercapto-type that are development restrainers of photothermographic systems as do U.S. Pat. Nos. 4,837,141 and 4,451,561. Mesoionic 1,2,4-triazolium-3-thiolates as fixing agents and silver halide stabilizers are described in U.S. Pat. No. 4,378,424. Substituted 5-mercapto-1,2,4-triazoles such as 3-amino-5-benzothio-1,2,4-triazole as post-processing stabilizers are described in U.S. Pat. No. 4,128,557; 4,137,079; 4,138,265, and Research Disclosure 16977 and 16979.

Some of the problems with these stabilizers include thermal fogging during processing or losses in photographic sensitivity, maximum density or, contrast at stabilizer concentrations in which stabilization of the post-processed image can occur.

Stabilizer precursors have blocking or modifying groups that are usually cleaved during processing with heat and/or alkali. This provides the remaining moiety or primary active stabilizer to combine with the photoactive silver halide in the unexposed and undeveloped areas of the photographic material. For example, in the presence of a silver halide precursor in which the sulfur atom is blocked upon processing, the resulting silver mercaptide will be more stable than the silver halide to light, atmospheric and ambient conditions.

Various blocking techniques have been utilized in developing the stabilizer precursors. U.S. Patent No. 3,615,617 describes acyl blocked photographically useful stabilizers. U.S. Pat. Nos. 3,674,478 and 3,993,661 describe hydroxyarylmethyl blocking groups. Benzylthio releasing groups are described in U.S. Pat. No. 3,698,898. Thiocarbonate blocking groups are described in U.S. Pat. No. 3,791,830, and thioether blocking groups in U.S. Pat. Nos. 4,335,200, 4,416.977, and 4,420,554. Photographically useful stabilizers which are blocked as urea or thiourea derivatives are described in U.S. Pat. No. 4,310,612. Blocked imidomethyl derivatives are described in U.S. Pat. No. 4,350,752, and imide or thioimide derivatives are described in U.S. Pat. No. 4,888,268. Removal of all of these aforementioned blocking groups from the photographically useful stabilizers is accomplished by an increase of pH during alkaline processing conditions of the exposed imaging material.

Other blocking groups which are thermally sensitive have also been utilized. These blocking groups are removed by heating the imaging material during processing. Photographically useful stabilizers blocked as thermally sensitive carbamate derivates are described in U.S. Pat. Nos. 3,844,797 and 4,144,072. These carbamate derivatives presumably regenerate the photographic stabilizer through loss of an isocyanate. Hydroxymethyl blocked photographic reagents which are unblocked through loss of formaldehyde during heating are described in U.S. Pat. No. 4,510,236. Development inhibitor releasing couplers releasing tetrazolylthio moieties are described in U.S. Pat. No. 3,700,457. Substituted benzylthio releasing groups are described in U.S. Pat. No. 4,678,735; and U.S. Pat. Nos. 4,351,896 and 4,404,390 utilize carboxybenzylthio blocking groups for mesoionic 1,2,4-triazolium-3-thiolates stabilizers. Photographic stabilizers which are blocked by a Michael-type addition to the carbon-carbon double bond of either acrylonitrile or alkyl acrylates are described in U.S. Pat. Nos. 4,009,029 and 4,511,644, respectively. Heating of these blocked derivatives causes unblocking by a retro-Michael reaction.

Various disadvantages attend these different blocking techniques. Highly basic solutions which are necessary to cause deblocking of the alkali sensitive blocked derivatives are corrosive and irritating to the skin. With the photographic stabilizers which are blocked with a heat removable group, it is often found that the liberated reagent or by-product, for example, acrylonitrile, can react with other components of the imaging construction and cause adverse effects.

Also, inadequate or premature release of the stabilizing moiety within the desired time during processing may occur.

Thus, there has been a continued need for improved post-processing stabilizers that do not fog or desensitize the photographic materials, and stabilizer precursors that release the stabilizing moiety at the appropriate time and do not have any detrimental effects on the photosensitive material or user of said material.

SUMMARY OF THE INVENTION

According to this invention, the incorporation of omega-substituted-2-propioamidoacetyl or omega-substituted-3-propioamidopropionyl stabilizer precursors of Formula I, below, and/or α-amidoacetyl or α-amidopropionyl derivatives of Formulas II and III, below, into the photothermographic emulsion layer or a layer adjacent to the emulsion layer stabilizes the silver halide for improved post-processing stabilization without desensitization or fogging the heat developable photographic material and process. The general formulae I, II and III describes such compounds thereof:

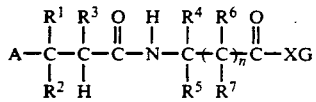

I

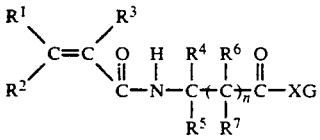

II

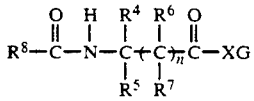

III wherein

A represents a residue of a post-processing stabilizer, AH, in which a hydrogen atom of the post-processing stabilizer has been replaced by the remainder of the structure shown in Formula I;

$R^1$, $R^2$, and $R^3$ are independently hydrogen or methyl, with the proviso that $R^1$ can also represent an aryl group when $R^2$ and $R^3$ are hydrogen;

$R^4$ and $R^5$ independently represent an alkyl group, a cyclo-alkyl group, an aryl group or $R^4$ and $R^5$ taken together with the carbon atom to which they are joined form a ring of 4 to 12 atoms (preferably 5 or 6 carbon atoms);

$R^6$ and $R^7$ are independently hydrogen or lower alkyl, preferably C-1 to C-4 alkyl;

$R^8$ is any organic group such as alkyl groups (e.g., of 1 to 20 carbon atoms, more preferably 1 to 12 carbon atoms, and inclusive of cycloalkyl of 3 to 20 carbon atoms, preferably 5 to 8 carbon atoms), aryl groups (e.g., up to 7 ring atoms) and heterocyclic groups (preferably of C, S, N, O and Se atoms with up to 7 ring atoms);

n is 0 or 1;

x represents an oxygen, nitrogen, or sulfur atom; and

G represents an organic ballasting group (e.g., alkyl group of up to 20 carbon atoms, aryl group of up to 20 carbon atoms, and mixed alkyl and aryl groups of up to 30 carbon atoms).

In this application:

"alkenyl" and "alkenylene" mean the monovalent and polyvalent residues remaining after removal of one and at least two hydrogen atoms, respectively, from an alkene containing 2 to 20 carbon atoms; functional groups which may be present are one or more aryl, amide, thioamide, ester, thioester, ketone (to include oxo-carbons), thioketone, nitrile, nitro, sulfide, sulfoxide, sulfone, disulfide, tertiary amine, ether, urethane, dithiocarbamate, quaternary ammonium and phosphonium, halogen, silyl, silyloxy, and the like, wherein the functional gorups requiring substituents are substituted with hydrogen, alkyl, or aryl groups where approprite; additionally, the alkenyl and alkenylene residues may contain one or more catenary S, O, N, P, and Si heteroatoms;

"alkyl" and "alkylene" mean the monovalent and polyvalent residues remaining after removal of one and at least two hydrogen atoms, respectively, from a linear or branched chain hydrocarbon having 1 to 20 carbon atoms, functional groups and catenary heteroatoms which may be present are the same as those listed under the "alkenyl" definition;

"aryl" and "arylene" mean the monovalent and polyvalent residues remaining after removal of one and at least two hydrogen atoms, respectively, from an aromatic compound (single ring and multi- and fused-cyclic) having 5 to 12 ring atoms in which up to 5 ring atoms may be selected from S, Si, O, N, and P heteroatoms, functional groups which also may be present are the same as those listed under the "alkenyl" definition;

"azlactone" means 2-oxazolin-5-one groups of Formula IV and 2-oxazin-6-one groups of Formula V.

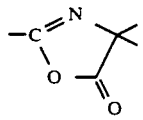

IV

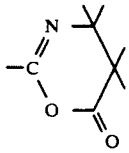

V

"Michael reaction" means the catalyzed or uncatalyzed addition of a "Michael donor," illustrated by a nitrogen nucleophile (VI) in the equation below, to an alkenyl azlactone "Michael acceptor" (VII) to form a "Michael adduct" reaction product (VIII):

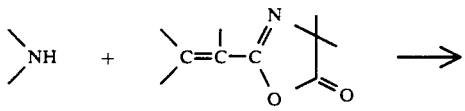

VI VII

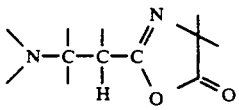

VIII

"Michael donor" means the nucleophilic reactant in a Michael reaction;

"Michael acceptor" means the electrophilic reactant in a Michael reaction;

"azlactone ring opening reaction" means the catalyzed or uncatalyzed addition reaction of a nucleophile, HXG (wherein X =O, S, NH, or NR and R means independent selections of alkyl and/or aryl groups), as illustrated by an HXG nucleophile in the equation below, to an azlactone (IV) to provide the α-amidoacetyl derivative (IX)

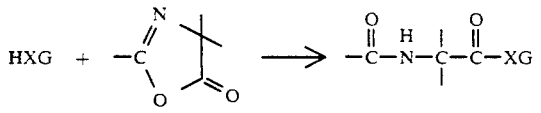

IV IX

The compositions of Formula I are formally the products of a ring-opening reaction of an azlactone Michael adduct of Formula X by an HXG nucleophile as shown in the equation below. The azlactone Michael adducts of Formula X are described extensively in pending application File No. 45053USA1A (U.S. Ser. No. 07/500,768 filed Mar. 29, 1990 in the name of Dean M. Moren) and the compositions of Formula I are described in detail in application File No. 45466 (U.S. Ser. No. 07/575,835 filed Aug. 31, 1990 in the name of Larry R. Krepski, et al.) USA5A.

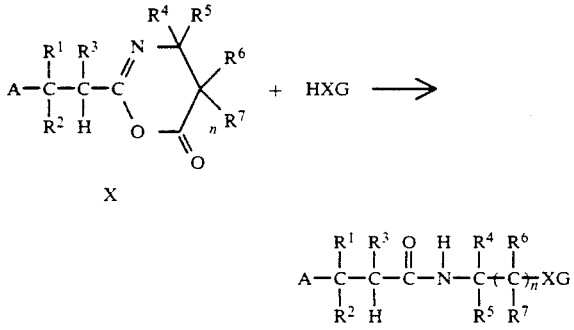

X wherein A, $R^1$, $R^2$, $R^3$, $R^4$, $R^5$, $R^6$, $R^7$, X, G and n are as described above.

The compositions of Formulae II and III are the products of ring-opening reactions of azlactones of Formulae XI and XII, respectively, by HXG nucleophiles as shown in the equation below. Reaction conditions for these azlactone ring opening reactions are described in detail in application File No. 45466USA5A.

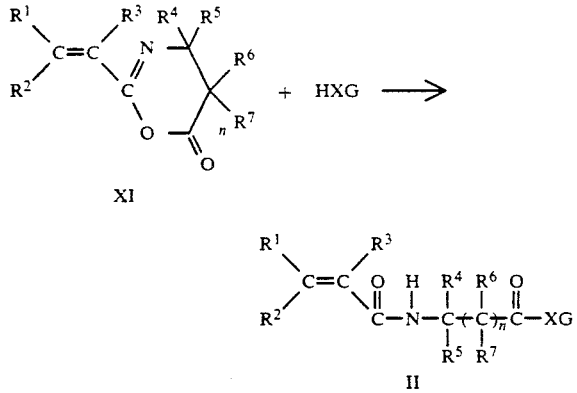

XI II

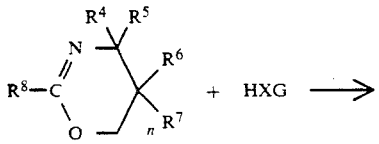

XII

-continued

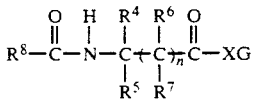

III wherein $R^1$, $R^2$, $R^3$, $R^4$, $R^5$, $R^6$, $R^7$, $R^8$, X, G and n are as described above.

DETAILED DESCRIPTION OF THE INVENTION

The addition of the novel omega-substituted-2-propioamidoacetyl or omega-substituted-3-propioamidopropionyl stabilizer precursors of Formula I, and/or the α-amidoacetyl and/or α-amidopropionyl compositions of Formulae II and III into the photothermographic emulsion layer or layer adjacent to the emulsion layer provides the photoactive silver halide emulsion with improved post-processing stability without desensitizing or fogging said emulsion.

In general Formula I, A represents the residue of a "primary" post-processing stabilizer, AH, in which the hydrogen atom has been replaced by the propioamidoacetyl or propioamidopropionyl group. The propioamidoacetyl or propioamidopropionyl group acts as a blocking group to block the activity of the primary stabilizer AH. If AH is left unblocked and added to the photographic emulsion at the same molar equivalent concentration as the composition of Formula I, AH desensitizes said emulsion. In addition to functioning as a blocking group for the "primary" post-processing stabilizer AH, the propioamidoacetyl or propioamidopropionyl functionality of the composition of Formula I has another function and that is to act as a "secondary" stabilizer for the image. The α-amidoacetyl and α-amidopropionyl compositions of Formulae II and III also act as "secondary" stabilizers. While not wishing to be bound by any particular reaction mechanism or explanation for the observed stabilization effect of the compositions of Formula I, it is possible that the combination of processing heat and the photothermographic environment causes release of the "primary" stabilizer AH from the composition of Formula I through a retro-Michael reaction. When AH is liberated in this retro-Michael reaction, the "secondary" stabilizer which is the composition of Formula II is also liberated in situ. It is thus possible by the present invention to provide secondary stabilization of the image by a composition of Formula II which is generated in situ by the decomposition of the composition of Formula I, or independently by the addition of the compositions of Formula II and/or III to the photothermographic imaging material.

Suitable primary stabilizers are well known in the art such as nitrogen-containing substituted or unsubstituted heterocyclic rings; such as benzimidazole, benzotriazole; triazoles; tetrazoles; imidazoles; various mercapto-containing substituted or unsubstituted compounds; such as mercapto triazoles, mercapto tetrazoles; thio-substituted heterocycles; or any such compound that stabilizes the said emulsion but at such concentrations desensitizes the initial sensitometric response if left unblocked. Many of such compounds are summarized in Research Disclosure 29963 from March, 1989 entitled "Photothermographic Silver Halide Systems".

Specific examples of the novel ring-opened azlactone-based stabilizer precursors and ring-opened azlactones are shown below, which, however, does not limit the compounds to be used in the present invention.

I-A

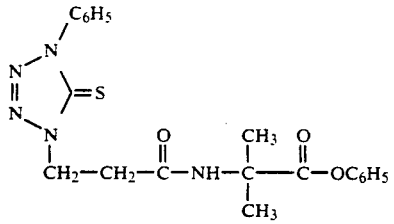

I-B

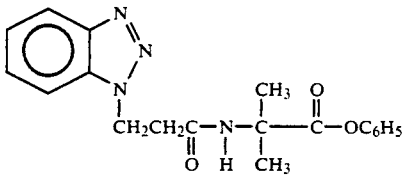

I-C

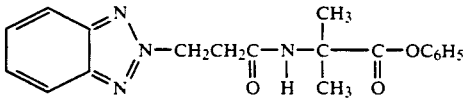

I-D

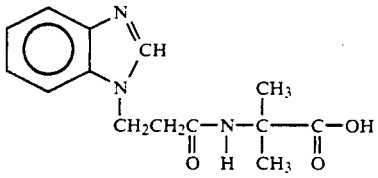

I-E

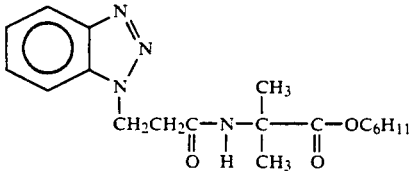

I-F

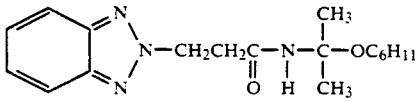

I-G

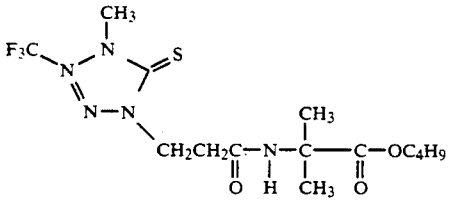

I-H

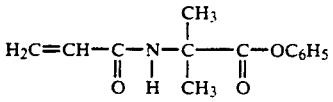

I-I

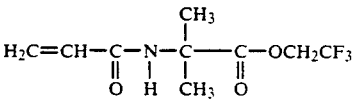

The general synthesis of the stabilizer precursors is described in the patent application entitled "Azlactone Michael Adducts", FN 45053USA1A. Specific synthesis examples of the compounds according to the present invention are set forth below.

In all cases, structures of the compounds were confirmed by spectral analysis, including IR, proton and carbon NMR spectroscopy.

SYNTHESIS EXAMPLE 1

Synthesis of Compound I-A

A mixture of VDM (2-vinyl-4,4-dimethylazlactone) (13.9 g, 0.10 mole) and 1-phenyl-1H-tetrazole-5-thiol (17.8 g, 0.10 mole) was heated at 100° C. overnight, then phenol (9.4 g, 0.10 mole) was added and the mixture heated at 70° C. for 22 hours. Since IR analysis indicated some residual azlactone absorbance at around 1800cm$^{-1}$, DBU (0.3 g) was added to reaction mixture and heating continued at 90° C. for 23 hours to complete the reaction. The product was recrystallized from aqueous ethanol.

SYNTHESIS EXAMPLE 2

Synthesis of Isomers I-B and I-C

A mixture of VDM (13.9 g, 0.10 mole) and benzotriazole (11.9 g, 0.10 mole) was heated at 100° C. overnight, then phenol (9.4 g, 0.10 mole) and DBU (0.2 g) were added and heating continued for 24 hours at 100° C. Recrystallization from aqueous ethanol gave the product as a mixture of 1-N-alkylated and 2-N-alkylated isomers in about a 4 to 1 ratio.

Synthesis of Isomers I-E and I-F

A mixture of VDM (13.9 g, 0.10 mole) and benzotriazole (11.9 g, 0.10 mole) were heated at 100° C. for 24 hours, then cyclohexanol (10.0 g, 0.10 mole) and DBU (0.3 g) were added and the mixture heated at 70° C. for 2 hours and then at 100° C. for 20 hours. Recrystallization from ethylacetate-toluene gave the product as a mixture of 1-N-alkylated and 2-N-alkylated isomers.

SYNTHESIS EXAMPLE 3

Synthesis of Compound I-D

VDM (13.9 g, 0.10 mole) and benzimidazole (11.8 g, 0.10 mole) were heated at 100° C. overnight. After cooling, tetrahydrofuran (50 ml) was added to dissolve the product, then water (10 ml) was added and the mixture allowed to stand at room temperature overnight. Evaporation of the solvent and recrystallization of the residue from aqueous ethanol gave the desired product.

SYNTHESIS EXAMPLE 4

Synthesis of Compound I-G

VDM (6.95 g, 0.05 mole), 4-methyl-5-trifluoromethyl-4H-1,2,4-triazolin-3(2H)-thione (9.1 g, 0.05 mole), and 1,8-diazabicyclo [5.4.0.] undec-7-ene (DBU) (0.3 g) were heated at 60° C. for 40 hours, then 1-butanol 7.4 g (0.05 mole) and DBU (0.3 g) were added and the mixture heated at 100° C. for 40 hours. Recrystallization from aqueous ethanol gave the desired product.

SYNTHESIS EXAMPLE 5

Synthesis of Compound I-H

To a mixture of VDM (13.9 g, 0.10 mole) and phenol (9.4 g, 0.10 mole) was added 0.3 g of DBU. After a brief exotherm, the material crystallized. Recrystallization from aqueous ethanol gave the desired product.

SYNTHESIS EXAMPLE 6

Synthesis of Compound I-I

To a mixture of VDM (13.9 g, 0.10 mole) and 2,2,2-trifluoroethanol (10.0 g, 0.10 mol) was added 0.3 g of DBU. After a brief exotherm, the product crystallized. Recrystallization from aqueous ethanol gave the desired product.

The amounts of the above described compounds according to the present invention which are added can be varied depending upon the particular compound used and upon the photothermographic emulsion-type. However, they are preferably added in an amount of $10^{-3}$ to 100 mol, and more preferably from $10^{-2}$ to 20 mol, per mol of silver halide in the emulsion layer.

The photothermographic dry silver emulsions of this invention may be constructed of one or more layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and some of the other ingredients in the second layer or both layers.

Multicolor photothermographic dry silver constructions contain sets of these bilayers for each color. Color forming layers are maintained distinct from each other by the use of functional or non-functional barrier layers between the various photosensitive layers as described in U.S. Pat. No. 4,460,681.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material constitutes from about 5 to 30 percent by weight of the imaging layer. The second layer in a two-layer construction or in the bilayer of a multi-color construction would not affect the percentage of the silver source material desired in the photosensitive single imaging layer.

The organic silver salt which can be used in the present invention is a silver salt which is comparatively stable to light, but forms a silver image when heated to 80° C. or higher in the presence of an exposed photocatalyst (such as silver halide) and a reducing agent.

Suitable organic silver salt include silver salts of organic compounds having a carboxy group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linoleate, silver butyrate and silver camphorate, mixtures thereof, etc. Silver salts which are substituted with a halogen atom of a hydroxyl group can also be effectively used. Preferred examples of the silver salts of aromatic carboxylic acid and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663, etc.

Silver salts of compounds containing mercapto or thione groups and derivatives thereof can be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(S-ethylglycolamido) benzothiazole, a silver salt of thioglycolic acid such as a silver salt of a S-alkyl thioglycolic acid (wherein the alkyl group has from 12 to 22 carbon atoms) as described in Japanese patent application No. 28221/73, a silver salt of a dithiocarboxylic acid such as a silver salt of dithioacetic acid, a silver salt of thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of thione compound such as a silver salt of 3-(2-carboxyethyl)-4-methyl-4-thiazoline-2-thione as disclosed in U.S. Pat. No. 3,301,678.

Furthermore, a silver salt of a compound containing an imino group can be used. Preferred examples of these compounds include a silver salt of benzothiazole and a derivative thereof as described in Japanese patent publications Nos. 30270/69 and 18146/70, for example, a silver salt of benzothiazole such as silver salt of methylbenzotriazole, etc., a silver salt of a halogen substituted benzotriazole, such as a silver salt of 5-chlorobenzotriazole, etc., a silver salt of carboimidobenzotriazole, etc., a silver salt of 1,2,4-triazole, of 1-H-tetrazole as described in U.S. Pat. No. 4,220,709, a silver salt of imidazole and an imidazole derivative, and the like.

It is also found convenient to use silver halfsoaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or 5 percent of free behenic acid and analyzing about 25.2 percent silver may be used.

The method used for making silver soap dispersions is well known in the art and is disclosed in Research Disclosure April 1983 (22812) ibid October 1983 (23419) and U.S. Pat. No. 3,985,565.

The light sensitive silver halide used in the present invention can be employed in a range of 0.0005 mol to 5 mol and, preferably, from 0.005 mol to 1.0 mol per mol of organic silver salt.

The silver halide may be any photosensitive silver halide such as silver bromide, silver iodide, silver chloride, silver bromoiodide, silver chlorobromoiodide, silver chlorobromide, etc.

The silver halide used in the present invention may be employed without modification. However, it may be chemically sensitized with a chemical sensitizing agent such as a compound containing sulphur, selenium or tellurium etc., or a compound containing gold, platinum, palladium, rhodium or iridium, etc., a reducing agent such as a tin halide, etc., or a combination thereof. The details of these procedures are described in T. H. James "The Theory of the Photographic Process", Fourth Edition, Chapter 5, pages 149 to 169.

The silver halide may be added to the emulsion layer in any fashion which places it in catalytic proximity to the silver source.

The silver halide and the organic silver salt which are separately formed in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are described in Research Disclosures, No. 170–29, Japanese patent applications Nos. 32928/75 and 42529/76, U.S. Pat. No. 3,700,458, and Japanese patent applications Nos. 13224/74 and 17216/75.

The use of preformed silver halide emulsions of this invention can be unwashed or washed to remove soluble salts. In the latter case the soluble salts can be removed by chill-setting and leaching or the emulsion can be coagulation washed, e.g., by the procedures described in Hewitson, et al., U.S. Pat. No. 2,618,556; Yutzy et al., U.S. Pat. No. 2,614,928; Yackel, U.S. Pat. No. 2,565,418;; Hart et al., U.S. Pat. No. 3,241,969; and Waller et al., U.S. Pat. No. 2,489,341. The silver halide grains may have any crystalline habit including, but not limited to cubic, tetrahedral, orthorhombic, tabular, laminar, platelet, etc.

Photothermographic emulsions containing preformed silver halide in accordance with this invention can be sensitized with chemical sensitizers, such as with reducing agents; sulfur, selenium or tellurium compounds; gold, platinum or palladium compounds, or combinations of these. Suitable chemical sensitization procedures are described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The light-sensitive silver halides can be spectrally sensitized with various known dyes including cyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malonitrile nucleus and a pyrazolone nucleus. In the above described cyanine and merocyanine dyes, those having imino groups or carboxyl groups are particularly effective. Practically, the sensitizing dye to be used in the present invention is properly selected from known dyes as described in U.S. Pat. No. 3,761,279, 3,719,495 and 3,877,943, British Pat Nos. 1,466,201, 1,469,117 and 1,422,057, Japanese Patent Application (OPI) Nos. 27924/76 and 156424/75, and so on, and can be located in the vicinity of the photocatalyst according to known methods used in the above-described examples. These spectral sensitizing dyes are used in amounts of about $10^{-4}$ mol to about 1 mol per 1 mol of photocatalyst.

The reducing agent for silver ion may be any material, preferably organic material, which will reduce silver ion to metallic silver. Conventional photographic developers such as phenidone, hydroquinones, and catechol are useful but hindered phenol reducing agents are preferred. The reducing agent should be present as 1 to 10 percent by weight of the imaging layer. In a two-layer construction, if the reducing agent is in the second layer, slightly high proportions, of from about 2 to 15 percent tend to be more desirable.

A wide range of reducing agents have been disclosed in dry silver systems including amidoximes such as phenylamidoxime, 2-thienylamidoxime and p-phenoxyphenylamidoxime, azine, e.g., 4-hydroxy-3,5-dimethoxybenzaldehyde azine; a combination of aliphatic carboxylic acid aryl hydrazides and ascorbic acid, such as 2,2-bis(hydroxymethyl)propionyl-beta-phenyl hydrazide in combination with ascorbic acid; a combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenyl hydrazine, hydroxamic acids such as phenylhydroxamic acid, p-hydroxyphenyl hydroxamic acid, and beta-alanine hydroxamic acid; a combination of azines and sulphonamidophenols, e.g., phenothiazine and 2,6-dichloro-4-benzenesulphonamidophenol; alphacyanophenylacetic acid derivatives such as ethyl-alpha-cyano-2-methylphenylacetate, ethyl alphacyanophenylacetate; bis-beta-naphthols as illustrated by 2,2'-dihydroxy-1,1'-binaphthyl, 6,6'-dibromo-2,2'-dihydroxy-1,1'-binaphthyl, and bis(2-hydroxy-1-naphthyl)methane; a combination of bis-beta-naphthol and a 1,3-dihydroxybenzene derivative, e.g., 2,4-dihydroxybenzophenone or 2'4'-dihydroxyacetophenone; 5-pyrazolones such as 3-methyl-1-phenyl-5-pyrazolone; reductones as illustrated by dimethylamino hexose reductone, anhydro dihydro amino hexose reductone, and anhydro dihydro piperidone hexose reductone; sulphonamidophenol reducing agents such as 2,6-dichloro-4-benzensulphonamidophenol, and p-benzenesulphonamidophenol; 2-phenylindane-1,3-dione and the like; chromans such as 2,2-dimethyl-7-t-butyl-6-hydroxychroman; 1,4-dihydro-pyridines such as 2,6-dimethoxy-3,5-dicarbethoxy-1,4-dihydropyridine; bisphenols e.g., bis(2-hydroxy-3-t-butyl-5-methylphenyl)methane, 2,2-bis(4-hydroxy-3-methylphenyl)propane, 4,4-ethylidene -bis(2-tert-butyl-6-methylphenol), and 2,2-bis(3,5-dimethyl-4-hydroxyphenyl)propane; ascorbic acid derivatives, e.g., 1-ascorbylpalmitate, ascorbylstearate and unsaturated aldehydes and ketones, such as benzyl and diacetyl; 3-pyrazolidones and certain indane-1,3-diones.

The literature discloses additives, "toners", which improve the image.

Toner materials may be present, for example, in amounts from 0.1 to 10 percent by weight of all silver bearing components. Toners are well known materials in the photothermographic art as shown in U.S. Pat. Nos. 3,080,254; 3,847,612 and 4,123,282.

Examples of toners include phthalimide and N-hydroxyphthalimide; cyclic imides such as succinimide, pyrazoline-5-ones, and a quinazolinone, 3-phenyl-2-pyrazoline-5-one, 1-phenylurazole, quinazoline, and 2,4-thiazolidinedione; naphthalimides, e.g., N-hydroxy- 1,8-naphthalimide; cobalt complexes, e.g., cobaltic hexamine trifluoroacetate; mercaptans as illustrated by 3-mercapto -1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryl dicarboximides, e.g. (N-dimethylaminomethyl)phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene bis(1-carbomoyl-3,5-dimethylpyrazole), 1,8-(3,6-diazaoctane)-bis(isothiuronium trifluoroacetate) and 2-(tribromomethylsulfonyl)benzothiazole); and merocyanine dyes such as 3-ethyl-5[(3-ethyl-2-benzothiazolinylidene)-1-methylethylidene]-2-thio-2,4-oxazolidinedione; phthalazinone, phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus sulphinic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate and potassium hexachlororhodate (III); inorganic peroxides and persulphates, e.g., ammonium peroxydisulphate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimidine, 2-hydroxy-4-aminopyrimidine, and azauracil, and tetrazapentalene derivatives, e.g, 3,6-dimercapto-1,4-diphenyl-1H,4H-2,3a,5,6a-tetrazapentalene, and 1,4-di(o-chloro-phenyl)3,6-dimercapto-lH,4H-2,3a,5,6a-tetrazapentalene.

A number of methods have been proposed for obtaining color images with dry silver systems. Such methods include incorporated coupler materials, e.g., a combination of silver benzotriazole, well known magenta, yellow and cyan dye-forming couplers, aminophenol developing agents, a base release agent such as guanidinium trichloroacetate and silver bromide in poly(vinylbutyral); a combination of silver bromoiodide, sulphonamidophenol reducing agent, silver behenate, poly(vinylbutyral), an amine such as n-octadecylamine and 2-equivalent or 4-equivalent cyan, magenta or yellow dye-forming couplers; incorporating leuco dye bases which oxidizes to form a dye image, e.g., Malachite Green, Crystal Violet and pararosaniline; a combination of in situ silver halide, silver behenate, 3-methyl-1-phenylpyrazolone and N,N'-dimethyl-p-phenylenediamine hydrochloride; incorporating phenolic leuco dye reducing agents such as 2-(3,5-di-tert-butyl-4-hydroxyphenyl)-4,5-diphenylimidazole, and bis(3,5-di-tert-butyl-4-hydroxyphenyl)phenylmethane, incorporating azomethine dyes or azo dye reducing agents; silver dye bleach process, e.g., an element comprising silver behenate, behenic acid, poly(vinylbutyral), poly(vinylbutyral)peptized silver bromoiodide emulsion, 2,6-dichloro-4-benzenesulphonamidophenol, 1,8-(3,6-diazaoctane)bis-isothiuronium-p-toluene sulphonate and an azo dye was exposed and heat processed to obtain a negative silver image with a uniform distribution of dye which was laminated to an acid activator sheet comprising polyacrylic acid, thiourea and p-toluene sulphonic acid and heated to obtain well defined positive dye images; and incorporating amines such as aminoacetanilide (yellow dye-forming), 3,3'-dimethoxybenzidine (blue dye-forming) or sulphanilide (magenta dye forming) which react with the oxidized form of incorporated reducing agents such as 2,6-dichloro-4-benzene-sulphonamido-phenol to form dye images. Neutral dye images can be obtained by the addition of amines such as behenylamine and p-anisidine.

Leuco dye oxidation in such silver halide systems are disclosed in U.S. Pat. Nos. 4,021,240, 4,374,821, 4,460,681 and 4,883,747.

Silver halide emulsions containing the stabilizers of this invention can be protected further against the additional production of fog and can be stabilized against loss of sensitivity during keeping. Suitable anti-foggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et. al., British Patent No. 623,448; nitron; nitroindazoles; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Stabilized emulsions of the invention can contain plasticizers and lubricants such as polyalcohols, e.g., glycerin and diols of the type described in Milton, U.S. Pat. No. 2,960,404; fatty acids or esters such as those described in Robins, U.S. Pat. No. 2,588,765 and Duane, U.S. Pat. No. 3,121,060; and silicone resins such as those described in DuPont British Patent No. 955,061.

The photothermographic elements can include image dye stabilizers. Such image dye stabilizers are illustrated by U.K. Patent No. 1,326,889; Lestina et al. U.S. Pat. Nos. 3,432,300 and 3,698,909; Stern et al. U.S. Pat. No. 3,574,627; Brannock et al. U.S. Pat. No. 3,573,050; Arai et al. U.S. Pat. No. 3,764,337 and Smith et al. U.S. Pat. No. 4,042,394.

Photothermographic elements containing emulsion layers stabilized according to the present invention can be used in photographic elements which contain light absorbing materials and filter dyes such as those described in Sawdey, U.S. Pat. No. 3,253,921; Gaspar U.S. Pat. No. 2,274,782; Carroll et a]., U.S. Pat. No. 2,527,583 and Van Campen, U.S. Pat. No. 2,956,879. If desired, the dyes can be mordanted, for example, as described in Milton and Jones, U.S. Pat. No. 3,282,699.

Photothermographic elements containing emulsion layers stabilized as described herein can contain matting agents such as starch, titanium dioxide, zinc oxide, silica, polymeric beads including beads of the type described in Jelley et al., U.S. Pat. No. 2,992,101 and Lynn, U.S. Pat. No. 2,701,245.

Emulsions stabilized in accordance with this invention can be used in photothermographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056, and 3,206,312 or insoluble inorganic salts such as those described in Trevoy, U.S. Pat. No. 3,428,451.

The binder may be selected from any of the well-known natural or synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic silver containing polymer is polyvinyl butyral, butethyl cellulose, methacrylate copolymers, maleic anhydride ester copolymers, polystyrene, and butadiene-styrene copolymers.

Optionally these polymers may be used in combination of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Photothermographic emulsions containing the stabilizer of the invention can be coated on a wide variety of supports. Typical supports include polyester film, subbed polyester film, poly(ethylene terephthalate)film, cellulose nitrate film, cellulose ester film, poly(vinyl acetal) film, polycarbonate film and related or resinous materials, as well as glass, paper metal and the like. Typically, a flexible support is employed, especially a paper support, which can be partially acetylated or coated with baryta and/or an alphaolefin polymer, particularly a polymer of an alpha-olefin containing 2 to 10 carbon atoms such as polyethylene, polypropylene, ethylenebutene copolymers and the like.

The substrate with backside resistive heating layer may also be used in color photothermographic imaging systems such as shown in U.S. Pat. No. 4,460,681 and 4,374,921.

Photothermographic emulsions of this invention can be coated by various coating procedures including dip coating, air knife coating, curtain coating, or extrusion coating using hoppers of the type descirbed in Benguin, U.S. Pat. No. 2,681,294. If desired, two or more layers may be coated simultaneously by the procedures described in Russell, U.S. Pat. No. 2,761,791 and Wynn British Patent No. 837,095.

The present invention will be i]]ustrated in detail in reference to the following examples, but the embodiment of the present invention is not limited thereto.

EXAMPLE 1

A dispersion of silver behenate half soap was made at 10% solids in toluene and acetone by homogenization. To 127g of this silver half soap dispersion was added 252g methyl ethyl ketone, 104g isopropyl alcohol and 0.5g of polyvinylbutyral. After 15 minutes of mixing 4 ml of mercuric bromide 0.36/10 ml methanol) were added. Then 8.0 ml of calcium bromide 0.236 g/10ml methanol) was added 30 minutes later. After two hours of mixing, 27.0 g of polyvinylpyrrolidone was added, and 27.0 g of polyvinylbutyral was added one hour later.

To 32.1 g of the prepared silver premix described above was added 2.0 ml of the sensitizing dye A (0.045 g/50ml of methanol) shown below.

A

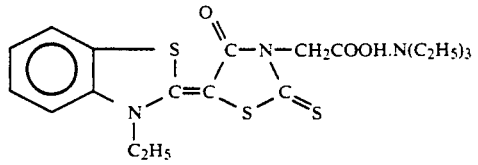

After 20 minutes, a yellow color-forming leuco dye solution was added as shown below.

| Component | Amount |
|---|---|
| Leuco Dye B | 0.275 g |
| Tribenzylamine | 0.24 g |
| Phthalazinone | 0.14 g |
| Tetrahydrofuran | 6.0 ml |

The leuco dye is disclosed in U.S. Pat. No. 4,883,747 and has the following formula:

B

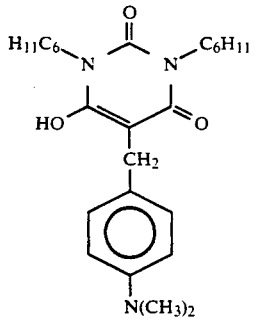

After sensitization with the dye and the addition of the leuco base dye solution, Compound I-A was added in the amounts of 0.2 ml or 0.5 ml at a concentration of 0.2 g/5 ml of methanol to 9.9 g aliquot of the yellow coating solution. The resulting solutions were coated along with a solution not containing any stabilizer precursor at a wet thickness of 3 mils and dried at 82° C. in an oven for 5 minutes onto a vesicular polyester base. A topcoat solution was coated at a wet thickness of 3 mils over the silver halide layer and dried at 82° C. in an oven for 5 minutes. The topcoat solution consisted of 7% polyvinyl alcohol in an approximate 50:50 mixture of water and methanol and 0.06% phthalazine.

The samples were exposed for $10^{-3}$ seconds through a 47B Wratten filter and a 0 to 3 continuous wedge and developed by heating to approximately 138° C. for 6 seconds. The density of the dye was measured using a blue filter of a computer densitometer. Post-processing stability was measured by exposing imaged samples to 1,200 ft-candles of illumination for 6 hours at 65% relative humidity and 26.7° C. The initial sensitometric data are shown below:

| | Dmin | Dmax | Speed[1] | Contrast[2] |
|---|---|---|---|---|
| Control (0.0 ml) | 0.11 | 2.46 | 1.77 | 5.09 |
| 0.2 ml I-A | 0.12 | 2.55 | 1.70 | 5.90 |
| 0.5 ml I-A | 0.13 | 2.54 | 1.72 | 5.78 |

[1]Log exposure corresponding to density of 0.6 above Dmin.
[2]Average contrast measured by the slope of the line joining density points 0.3 and 0.9 above Dmin.

The post-processing print stability results are shown below:

| | ΔDmin | ΔDmax |
|---|---|---|
| Control (0.0 ml) | +0.48 | −0.02 |
| 0.2 ml I-A | +0.46 | −0.03 |
| 1.0 ml I-A | +0.38 | −0.02 |

A 20% improvement in the post-processing Dmin was observed vs. unstabilized control with little effect on initial sensitometric responses.

EXAMPLE 1A

Comparison

To 9.9 g of the silver halide coating solution as described in Example 1 was added 1.0 ml of 1-phenyl-5-mercapto-tetrazole (PMT) at a concentration of 0.1 g/5 ml methanol. The silver solutions and topcoats were coated, exposed and processed as described in Example 1. The initial sensitometric data are shown below.

| | Dmin | Dmax | Speed[1] | Contrast[2] |
|---|---|---|---|---|
| Control (0.0 ml) | 0.14 | 2.52 | 1.73 | 5.01 |
| 0.5 ml PMT | 0.12 | 1.02 | 2.36 | 0.36 |

[1]Log exposure corresponding to density of 0.6 above Dmin.
[2]Average contrast measured by the slope of the line joining density points 0.3 and 0.9 above Dmin.

The post-processing print stability was measured as described in Example 1 and the results are shown below.

| | ΔDmin | ΔDmax |
|---|---|---|
| Control (0.0 ml) | +0.50 | −0.06 |
| 1.0 ml PMT | +0.18 | −0.11 |

At these concentrations of PMT, significant desensitization of the silver halide emulsion has occured for post-processing Dmin improvements. In Example 1, PMT was successfully blocked to minimize any desensitization effects but still allowed release of some PMT for the Dmin post-processing improvements.

EXAMPLE 2

A magenta color-forming silver halide dispersion was prepared by using 502 g of the silver half soap dispersion of Example 1 and adding 0.4 g of polyvinylbutyral. After 15 minutes of mixing, a 0.5 g/9.75g mercuric acetate in methanol solution and a 0.55 g/18.4g calcium bromide in methanol solution were added. Then an additional 0.55 g/18.4g calcium bromide in methanol solution was added 30 minutes later. After 45 minutes of mixing 49.8g of polyvinylbutyral was added.

To 35.8 g of the prepared silver premix described above was added 1.4 ml of the sensitizing dye c (0.021 g/100 ml of methanol) shown below.

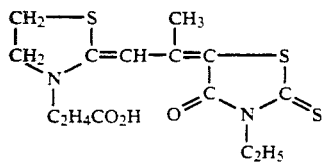

After 30 minutes, a magenta color-forming leuco dye solution was added as shown below.

| Component | Amount |
|---|---|
| Leuco Dye D | 0.593 g |
| Phthalazinone | 0.901 g |
| Tetrahydrofuran | 47.6 g |
| VAGH (Union Carbide) | 2.2 g |
| Polyvinylbutyral | 10.2 g |

The leuco dye is disclosed in U.S. Pat. No. 4,795,697 and has the following formula.

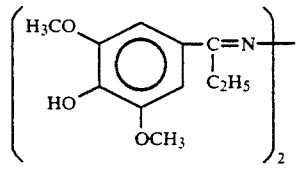

A topcoat solution was prepared consisting of 24.0% polystyrene resin in approximately 52% tetrahydrofuran, 17% toluene, 2% acetone and 5% methanol.

To 10.0g of magenta silver coating solution was added 0.67 ml or 1.0 ml of the isomer mixture, compounds I-B and I-C, at a concentration of 0.3 g/3ml of methanol and 2 ml of tetrahydrofuran, or 0.65 ml of benzotriazole (BZT) at a concentration of 0.1 g/5ml of methanol. The magenta silver layer and topcoat were coated simultaneouosly at a wet thickness of 2 mils, respectively and dried for 5 minutes at 82° C. The samples were exposed for $10^{-3}$ seconds through a 58 Wratten filter and a 1 to 3 continuous wedge and developed by heating to approximately 138° C. for 6 seconds.

The density of the dye for each sample was measured using a green filter of a computer densitometer. Post-processing stability was measured by exposing imaged samples to 1200 ft-candles of illumination for 7 hours at 65% relative humidity and 26.7° C. The initial sensitometric data are shown below.

| | Dmin | Dmax | Speed[1] | Contrast[2] |
|---|---|---|---|---|
| Control (0.0 ml) | 0.08 | 1.92 | 1.93 | 2.03 |
| 0.65 ml BZT | 0.08 | 0.20 | — | — |
| 0.67 ml I-B + I-C | 0.08 | 1.98 | 1.98 | 2.03 |
| 1.0 ml I-B + I-C | 0.08 | 1.89 | 2.02 | 2.01 |

[1]Log exposure corresponding to density of 0.6 above Dmin.
[2]Average contrast measured by the slope of the line joining density points 0.3 and 0.9 above Dmin.

The post processing print stability was measured and the results are shown below.

| | ΔDmin | ΔDmax |
|---|---|---|
| Control (0.0 ml) | +0.18 | −0.16 |
| 0.65 ml BZT | +0.13 | — |
| 0.67 ml I-B + I-C | +0.16 | −0.14 |
| 1.0 ml I-B + I-C | +0.14 | −0.21 |

At this concentration of benzotriazole, Dmin post-processing improvements were observed, but significant desensitizatin of the silver halide emulsion had occurred. With the addition of I-B+I-C, BZT was adequately blocked to minimize any desensitization and yet release of BZT occurred at the appropriate time for Dmin post-processing impovements similar to the unblocked BZT stabilizer.

EXAMPLE 3

To 10.0 g of a magenta silver halide solution, as described in Example 2, was added 0.95 ml of compound I-D at a concentration of 0.1 g/2.5 ml of methanol and 2.5 ml tetrahydrofuran or 0.65 ml of benzimidazole (BI) at a concentration of 0.1 g/5 ml of methanol. The silver solutions and topcoats were coated, exposed, and processed as described in example 2. The initial sensitometric data are shown below.

| | Dmin | Dmax | Speed[1] | Contrast[2] |
|---|---|---|---|---|
| Control (0.0 ml) | 0.08 | 1.92 | 1.93 | 2.03 |
| 0.65 ml BI | 0.08 | 1.59 | 2.64 | 1.94 |
| 0.95 ml I-D | 0.08 | 1.88 | 2.01 | 1.94 |

[1]Log exposure corresponding to density of 0.6 above Dmin.
[2]Average contrast measured by the slope of the line joining density points 0.3 and 0.9 above Dmin.

The post-processing print stability was measured as described in Example 2, and the results are shown below.

| | ΔDmin | ΔDmax |
|---|---|---|
| Control (0.0 ml) | +0.18 | −0.16 |
| 0.65 ml BI | +0.14 | −0.27 |
| 0.85 ml I-D | +0.15 | −0.24 |

At this concentration of benzimidazole, Dmin post-processing improvements are observed with significant desensitization of the silver halide emulsion. With the addition of I-D, BI was adequately blocked to minimize any desensitization and yet release of the BI occurred at the appropriate time during processing for Dmin post-processing improvements similar to the unblocked BI stabilizer.

EXAMPLE 4

To 9.9 g of the yellow silver halide coating solution as described in Example 1, was added 0.2 ml or 1.0 ml of the isomer mixture, compounds I-E and I-F, at a concentration of 0.2 g/5 ml of methanol. The topcoat was similar to that described in Example 1. The silver solutions and topcoats were coated, exposed and processed as described in Example 1. The initial sensitometric data are shown below.

| | Dmin | Dmax | Speed[1] | Contrast[2] |
|---|---|---|---|---|
| Control (0.0 ml) | 0.12 | 2.49 | 1.90 | 5.64 |
| 0.2 ml I-E + I-F | 0.12 | 2.45 | 1.91 | 5.40 |
| 1.0 ml I-E + I-F | 0.11 | 2.32 | 1.96 | 5.28 |

[1]Log exposure corresponding to density of 0.6 above Dmin.
[2]Average contrast measured by the slope of the line joining density points 0.3 and 0.9 above Dmin.

The post-processing print stability was measured and the results are shown below.

| | ΔDmin | ΔDmax |
|---|---|---|
| Control (0.0 ml) | +0.56 | −0.10 |
| 0.2 ml I-E + I-F | +0.50 | −0.13 |
| 1.0 ml I-E + I-F | +0.34 | −0.17 |

A 40% improvement in the post-processing Dmin was observed vs. the unstabilized control with little effect on the initial sensitometric response.

EXAMPLE 4-A

Comparison

To 9.9 g of the yellow silver coating solution as described in Example 4, was added 1.0 ml of benzotriazole (BZT) at a concentration of 0.1 g/5 ml of methanol. The topcoat was the same as used in Example 4, and the silver solutions and topcoats were coated, exposed and processed as described in Example 4. The initial sensitometric data are shown below.

| | Dmin | Dmax | Speed[1] | Contrast[2] |
|---|---|---|---|---|
| Control (0.0 ml) | 0.12 | 2.22 | 1.84 | 4.52 |
| 1.0 ml BZT | 0.11 | 0.30 | | |

[1]Log exposure corresponding to density of 0.6 above Dmin.
[2]Average contrast measured by the slope of the line joining density points 0.3 and 0.9 above Dmin.

The post-processing print stability results are shown below.

| | ΔDmin | ΔDmax |
|---|---|---|
| Control (0.0 ml) | +0.47 | −0.20 |
| 1.0 ml BZT | +0.17 | — |

At this concentration of BZT, significant desensitization of the silver halide emulsion had occurred for post-processing Dmin improvements. In Example 4, BZT was blocked to minimize any desensitization effects but still allowed the release of BZT at the appropriate time during processing for similar post-processing Dmin stabilization at the equivalent molar concentration as the unblocked BZT stabilizer.

EXAMPLE 5

To 9.9 g of the yellow silver halide coating solution as described in Example 1, was added 0.5 ml or 1.0 ml of compound I-G at a concentration of 0.44 g/5 ml of methanol, or 0.5 ml or 1.0 ml of 4-methyl-5-trifluoromethyl-4H-1,2,4-triazoline-3(2H)-thione (MFT) at a concentration of 0.2 g/5 ml of methanol. The topcoat was similar to that described in Example 1. The silver solutions and topcoats were coated, exposed, and processed as described in Example 1. The initial sensitometric data are shown below.

| | Dmin | Dmax | Speed[1] | Contrast[2] |
|---|---|---|---|---|
| Control (0.0 ml) | 0.09 | 2.42 | 1.96 | 5.00 |
| 0.5 ml MFT | 0.09 | 1.90 | 2.12 | 4.11 |
| 1.0 ml MFT | 0.09 | 0.10 | — | — |
| 0.5 ml I-G | 0.11 | 2.44 | 1.78 | 5.33 |
| 1.0 ml I-G | 0.11 | 2.29 | 1.82 | 5.71 |

[1]Log exposure corresponding to density of 0.6 above Dmin.
[2]Average contrast measured by the slope of the line joining density points 0.3 and 0.9 above Dmin.

The post-processing print stability was measured and the results are shown below.

| | ΔDmin | ΔDmax |
|---|---|---|
| Control (0.0 ml) | +0.64 | −0.06 |
| 0.5 ml MFT | +0.36 | −0.13 |
| 1.0 ml MFT | +0.16 | |
| 0.5 ml I-G | +0.39 | −0.07 |
| 1.0 ml I-G | +0.23 | −0.12 |

At these concentrations of MFT, significant desensitization of the silver halide occurs with the Dmin post-processing stabilization. The blocking of MFT, as shown in compound I-G, allows significant Dmin post-processing improvements similar to the equivalent molar amounts of the unblocked MFT stabilizer without losses in sensitivity.

EXAMPLE 6

To 9.9 g of the yellow silver solution described in Example 5, was added 1.0 ml of comopund I-H or 1.0 ml of compound I-I at a concentration of 0.255 g/3 ml of ethanol and 2 ml tetrahydrofuran and 0.26 g/3 ml of methanol and 2 ml tetrahydrofuran, respectively. The topcoat was the same as described in Example 5, and the silver solutions and topcoats were coated, exposed, and processed as described in Example 1. The initial sensitometric data are shown below.

| | Dmin | Dmax | Speed[1] | Contrast[2] |
|---|---|---|---|---|
| Control (0.0 ml) | 0.11 | 2.42 | 1.85 | 5.57 |
| 1.0 ml I-H | 0.11 | 2.32 | 1.74 | 5.35 |
| 1.0 ml I-I | 0.11 | 2.39 | 1.77 | 5.78 |

[1]Log exposure corresponding to density of 0.6 above Dmin.
[2]Average contrast measured by the slope of the line joining density points 0.3 and 0.9 above Dmin.

The post-processing results are shown below.

| | ΔDmin | ΔDmax |
|---|---|---|
| Control (0.0 ml) | +0.51 | −0.06 |
| 1.0 ml I-H | +0.33 | −0.01 |
| 1.0 ml I-I | +0.41 | −0.06 |

With little effect on the initial sensitometric responses, compounds I-H and I-I improved the Dmin post-processing stability 35% and 20%, respectively. The α-amidoacetyl derivatives function as post-processing stabilizers and, thus, will contribute to the overall post-processing Dmin improvement as the blocking moiety to post-processing stabilizer precursors.

What is claimed is:

1. A photothermographic imaging element comprising a substrate having on at least one side thereof a layer comprising a photographic silver halide in reactive association with a silver source material, a reducing agent for silver ion, and a binder, said layer having therein or in an adjacent layer a post processing stabilizing amount of an amido compound selected from the group consisting of 1) the adduct of an alkenyl-omega-amidoacetyl compound and a post-processing stabilizer compound for silver halide emulsions, 2) the adduct of an alkenyl-omega-amidopropionyl compound and a post-processing stabilizer compound for silver halide emulsions, and 3) an omega-amidoacetyl compound or omega-amidopropionyl compound.

2. The element of claim 1 wherein said amido compound is represented by the formulae:

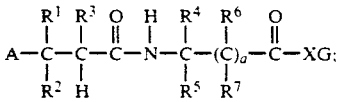

I

-continued

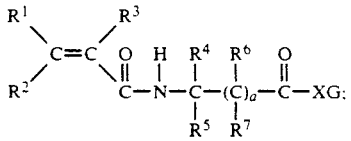

II or

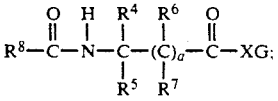

III wherein

A represents a post-processing stabilizer in which a hydrogen atom of the post-processing stabilizer has been replaced by the remainder of the structure shown in Formula I;

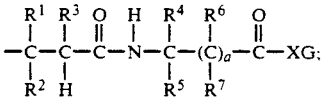

$R^1$, $R^2$, and $R^3$ are independently hydrogen or methyl and with the proviso that $R^1$ can represent an aryl group when $R^2$ and $R^3$ are hydrogen;

$R^4$ and $R^5$ independently represent an alkyl group, a cyclo-alkyl group, an aryl group or $R^4$ and $R^5$ taken together with the carbon atom to which they are joined form a ring of 4 to 12 atoms;

$R^6$ and $R^7$ are independently hydrogen or lower alkyl;

$R^8$ is an organic group selected from the group consisting of alkyl groups, aryl groups and heterocyclic ring groups of C, S, N, O and Se atoms with up to 7 ring atoms;

n is 0 or 1;

X represents an oxygen, nitrogen, or sulfur atom; and G represents an organic ballasting group.

3. The element of claim 2 wherein G is an alkyl group of 1 to 20 carbon atoms.

4. The element of claim 2 wherein $R^1$, $R^2$, $R^3$, $R^4$, $R^5$, $R^6$ and $R^7$ are independently H or methyl and are independently selected from H and alkyl.

5. The element of claim 2 wherein G represents an aryl group of 5 to 12 ring atoms.

6. The element of claim 2 wherein X is oxygen.

7. The element of claim 2 wherein X is sulfur.

8. The element of claim 2 wherein X is nitrogen and G comprises two ballasting groups on the nitrogen.

9. The element of claim 1 wherein said amido compound is present in said element in an amount of from $10^{-3}$ to 100 mols per mole of silver halide in said element.

10. The element of claim 2 wherein said amido compound is present in said element in an amount of from $10^{-3}$ to 100 mols per mole of silver halide in said element.

11. The element of claim 3 wherein said amido compound is present in said element in an amount of from $10^{-3}$ to 100 mols per mole of silver halide in said element.

12. The element of claim 4 wherein said amido compound is present in said element in an amount of from $10^{-3}$ to 100 mols per mole of silver halide in said element.

13. The element of claim 5 wherein said amido compound is present in said element in an amount of from $10^{-3}$ to 100 mols per mole of silver halide in said element.

14. The element of claim 6 wherein said amido compound is present in said element in an amount of from $10^{-3}$ to 100 mols per mole of silver halide in said element.

15. The element of claim 2 wherein $R^4$, $R^5$ and the carbon atom to which they are joined form a ring of 4 to 12 atoms.

16. The element of claim 2 wherein A is selected from the group consisting of benzotriazoles, benzimidazoles, triazoles, tetrazoles, imidazoles, mercaptotetrazoles, mercaptotriazoles, and thio-substituted heterocyclics.

17. The element of claim 6 wherein A is selected from the group consisting of benzotriazoles, benzimidazoles, triazoles, tetrazoles, imidazoles, mercaptotetrazoles, mercaptotriazoles, and thio-substituted heterocyclics.

18. The element of claim 12 wherein A is selected from the group consisting of benzotriazoles, benzimidazoles, triazoles, tetrazoles, imidazoles, mercaptotetrazoles, mercaptotriazoles, and thio-substituted heterocyclics.

19. The element of claim 14 wherein A is selected from the group consisting of benzotriazoles, benzimidazoles, triazoles, tetrazoles, imidazoles, mercaptotetrazoles, mercaptotriazoles, and thio-substituted heterocyclics.

20. The element of claim 9 wherein A is selected from the group consisting of benzotriazoles, benzimidazoles, triazoles, tetrazoles, imidazoles, mercaptotetrazoles, mercaptotriazoles, and thio-substituted heterocyclics.

21. A photothermographic imaging element comprising a substrate having on at least one side thereof a layer comprising a photographic silver halide in reactive association with a silver source material, a reducing agent for silver ion, and a binder, said layer having therein or in an adjacent layer a post processing stabilizing amount of an amino compound selected from the group consisting of 1) the adduct of an alkenyl-omega-amidoacetyl compound and a post-processing stabilizer compound for silver halide emulsions, 2) the adduct of an alkenyl-omega-amidopropionyl compound and a post processing stabilizer compound for silver halide emulsions, and 3) an omega-amidoacetyl compound or omega-amidopropionyl compound wherein said amido compound is represented by the formulae:

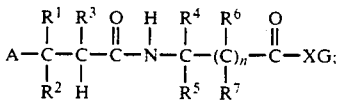

I

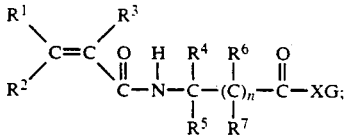

II or

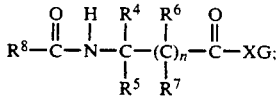

III wherein

A represents a post-processing stabilizer in which a hydrogen atom of the post-processing stabilizer has been replaced by

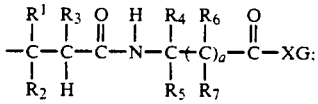

$R^1$, $R^2$, and $R^3$ are independently hydrogen or methyl and with the proviso that $R^1$ can represent an aryl group when $R^2$ and $R^3$ are hydrogen;

$R^4$ and $R^5$ independently represent an alkyl group, a cyclo-alkyl group, an aryl group or $R^4$ and $R^5$ taken together with the carbon atom to which they are joined form a ring of 4 to 12 atoms;

$R^6$ and $R^7$ are independently hydrogen or lower alkyl of 1 to 4 carbon atoms;

$R^8$ is any organic group;

n is 0 or 1;

X represents an oxygen, nitrogen, or sulfur atom; and

G represents an organic ballasting group.

22. The element of claim 21 wherein $R^8$ is selected from the group consisting of alkyl group 5 of 1 to 12 carbon atoms, cycloalkyl groups of 3 to 20 carbon atoms, aryl groups, and heterocyclic ring groups of C, S, N, O, and Se atoms with up to 7 ring atoms.

* * * * *

UNITED STATES PATENT AND TRADEMARK OFFICE

CERTIFICATE OF CORRECTION

PATENT NO. : 5,158,866

DATED : October 27, 1992

INVENTOR(S) : Simpson et al.

It is certified that error appears in the above-identified patent and that said Letters Patent is hereby corrected as shown below:

Col. 5, Formula X

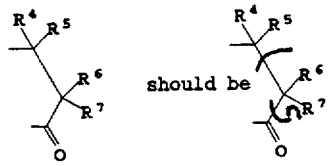

and

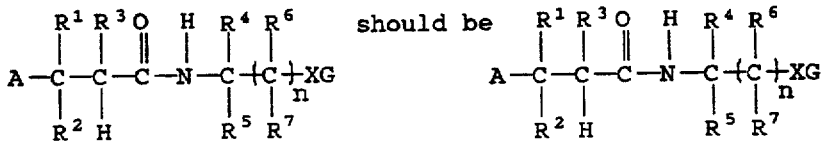

I

Col. 5, Formula XI

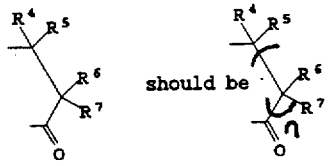

UNITED STATES PATENT AND TRADEMARK OFFICE

CERTIFICATE OF CORRECTION

PATENT NO. : 5,158,866

DATED : October 27, 1992

INVENTOR(S) : Simpson et al.

It is certified that error appears in the above-indentified patent and that said Letters Patent is hereby corrected as shown below:

Col. 5,
Formula XII

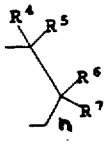

should be

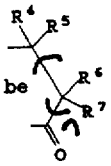

Signed and Sealed this

Thirteenth Day of September, 1994

*Attest:*

*Attesting Officer*

BRUCE LEHMAN

*Commissioner of Patents and Trademarks*